United States Patent [19]

Sharp et al.

[11] 4,368,852

[45] Jan. 18, 1983

[54] COMBINATION SPRAY GUN AND PRESSURE REGULATOR

[75] Inventors: William J. Sharp, Wakeman; Harold D. Beam, Kipton; William A. Armstrong, Greenwich, all of Ohio

[73] Assignee: Nordson Corporation, Amherst, Ohio

[21] Appl. No.: 246,743

[22] Filed: Mar. 23, 1981

[51] Int. Cl.[3] ..... B05B 5/02; B05B 7/12

[52] U.S. Cl. ..... 239/695; 137/505.39; 239/706; 239/76

[58] Field of Search ..... 137/505.39; 239/690, 239/695, 704–708, 76, 533.1, 570

[56] References Cited

U.S. PATENT DOCUMENTS

| | | | |
|---|---|---|---|
| 2,819,728 | 1/1958 | Gage et al. | 137/505.39 |
| 3,219,276 | 11/1965 | Norris | 239/695 X |
| 3,870,233 | 3/1975 | Wilhelm et al. | 239/70 X |
| 3,873,023 | 3/1975 | Moss et al. | 239/705 X |

*Primary Examiner*—Andres Kashnikow
*Attorney, Agent, or Firm*—Wood, Herron & Evans

[57] ABSTRACT

Electrostatic spray guns are connected in series to a pressurized source of liquid spray material. Each gun has an attached pressure regulator for evening the pressure of liquid supplied to the gun and the consequent spray pattern emitted from the gun. Each regulator is so constructed that it minimizes the pressure drop of liquid passing through the regulator to the next series connected regulator. Additionally, each regulator is made primarily from a low capacitance plastic material so that it cannot store and discharge an electrical potential sufficient to create a dangerous condition in a spray environment. Each regulator is so constructed that it may be manually adjusted to vary the pressure of liquid supplied from the regulator to the attached gun or may be easily converted to pneumatic control.

10 Claims, 2 Drawing Figures

COMBINATION SPRAY GUN AND PRESSURE REGULATOR

This invention relates to paint spray apparatus and more particularly to apparatus for spraying liquid from a spray gun at a constant flow rate. Specifically, the invention relates to a paint spray system including a spray gun equipped with an attached pressure regulator operable to maintain an even pressure in the coating material supplied to the gun so as to effect a constant flow pattern in the sprayed material emitted from the guns.

Pressure regulating valves have been regularly used in the past in spray coating systems to assure a supply of liquid at a constant pressure to the spray guns. Examples of such prior art uses of regulating valves are to be found in U.S. Pat. No. 3,385,522 and U.S. Pat. No. 3,870,233. Because of pressure variations inherent in systems used to supply liquid spray material to a spray gun, it has been common practice to pressurize a source of liquid material to a relatively high pressure and to then reduce this high pressure to a desired gun pressure by means of a pressure regulating valve located in the liquid supply line between the high pressure source and the gun.

One difficulty which has been encountered when utilizing multiple series connected guns to spray liquid supplied from a common source, has been that of having the liquid experience a pressure drop in the course of passage through one pressure regulator to the next. Consequently, the liquids supplied to the second or third regulator in a series was at a lesser pressure than that supplied to the first regulator in the series. This problem has heretofore been particularly acute in the case of liquids containing high solids content, i.e. a large percentage of paint solids relative to liquid. Such high solids spray materials are particularly susceptible to experiencing a pressure drop when flowed through conventional prior art pressure regulators.

It has therefore been an objective of this invention to provide an improved pressure regulator for use in combination with series connected paint spray guns in which there is little or no pressure drop in the liquid flowing from a common pressurized source of liquid through multiple series connected regulators.

Another difficulty which has been encountered with prior art regulators utilized in combination with paint spray guns has resulted from the requirement for the regulator to be located a substantial distance from the gun whenever the regulator was used in combination with a gun of the type which sprayed electrostatically charged materials. Quite commonly, liquid materials sprayed from a spray gun have electrical charge applied to the spray before it contacts a workpiece or sprayed object so as to increase the deposition efficiency of the spray system. However, the application of that electrical charge to the spray requires that the spray gun be equipped with a high voltage needle or other charge applying element. For safety reasons that charge applying element has been required to be electrically insulated from all exposed components of the spray system because contact with an uninsulated component could cause a personnel injury or the creation of a dangerous electrical spark in an explosive environment. Therefore, in the past pressure regulators used in electrostatic spray systems because of their potential for receiving and storing or leaking an electrical charge from the charge applying needle or component of the system, have been required to be separated from the spray gun by a substantial length of paint spray line or conduit so as to maintain a minimum specified safe distance or electrical "standoff" between the electrostatic spray gun and the pressure regulator. However, this electrical "standoff" has been undesirable because of its requiring additional fluid flow lines in the system with consequent pressure drop and/or heat losses, if as is often the case, the liquid is one which is heated before it is sprayed.

Therefore, it has been another objective of this invention to provide an improved pressure regulator useful in combination with an electrostatic spray gun which does not require any electrical standoff or specified minimum distance between the spray gun and the pressure regulator. Otherwise expressed, it has been another objective of this invention to provide a pressure regulator which could safely be used in an electrostatic paint spray system and attached directly to the spray gun of the system.

Still another difficulty experienced with prior art pressure regulators when used in combination with paint spray guns, has been the inflexibility of the system incorporating the regulator. This inflexibility derives from the fact the regulators have either been of the mechanical style which utilized a manually adjusted spring to vary the output pressure of the regulator, or of the pneumatic style which utilized air pressure to control the liquid pressure emitted from the regulator. Oftentimes though a customer desires, or a manufacturer desires, to manufacture a single regulator capable of being conveniently changed from mechanical control to pneumatic control or vice versa. Prior art regulators have not been amenable to such conversion.

It has therefore been another object of this invention to provide a pressure regulator utilizable in combination with a paint spray system which is mechanically controllable and adjustable via an adjustable spring contained internally of the regulator but which is also readily convertible to pneumatic control by simply removing the spring and screw adjustment and connecting a control air line to the regulator.

The pressure regulator of this invention, which is particularly useful in combination with paint spray systems to accomplish these objectives, comprises a regulator having an all plastic outer casing of such low capacitance that it cannot leak or store any appreciable electrical charge through the regulator. Consequently, this regulator may be mounted directly upon the spray gun without the need for any electrical "standoff" between the gun and the regulator. The body of this regulator has a straight through flow passage which enables multiple regulators to be connected in series without any pressure drop in the liquid flowing through series connected regulators, even when the liquid is a high solids content paint or spray material particularly susceptible to pressure drops. Additionally, this regulator has a control chamber contained internally of the regulator body which is divided into upper and lower chambers separated by a flexible diaphragm. A piston is attached to this diaphragm, which is in turn attached to a needle of the regulator. This needle cooperates with a needle valve seat contained internally of the regulator for controlling pressure drop of liquid supplied through the regulator to the attached spray gun. An adjustable spring normally biases this piston and attached needle valve to an open position, but this spring and the adjustment screw for varying the compression of the spring are removable so that an air line may be attached in place of the adjustment screw for purposes of converting the regulator from a manually adjustable regulator to a pneumatically controlled regulator.

The primary advantage of this invention is that it provides a pressure regulator particularly useful in combination with paint spray systems which overcomes all of the difficulties set forth hereinabove. Specifically, this regulator, when used in combination with an electrostatic paint spray gun may be mounted directly upon the gun without the need for any electrical standoff between the gun and the regulator and without creating any potential safety hazard or reducing the spray efficiency of the gun. This regulator may also be connected in series to multiple other regulators without creating a pressure drop in the liquid flowing from one regulator to the next. This regulator also has the advantage of being readily convertible from a mechanically adjustable spring type control to pneumatic control.

These and other objects and advantages of this invention will be more readily apparent from the following description of the drawings in which.

Figure 1:
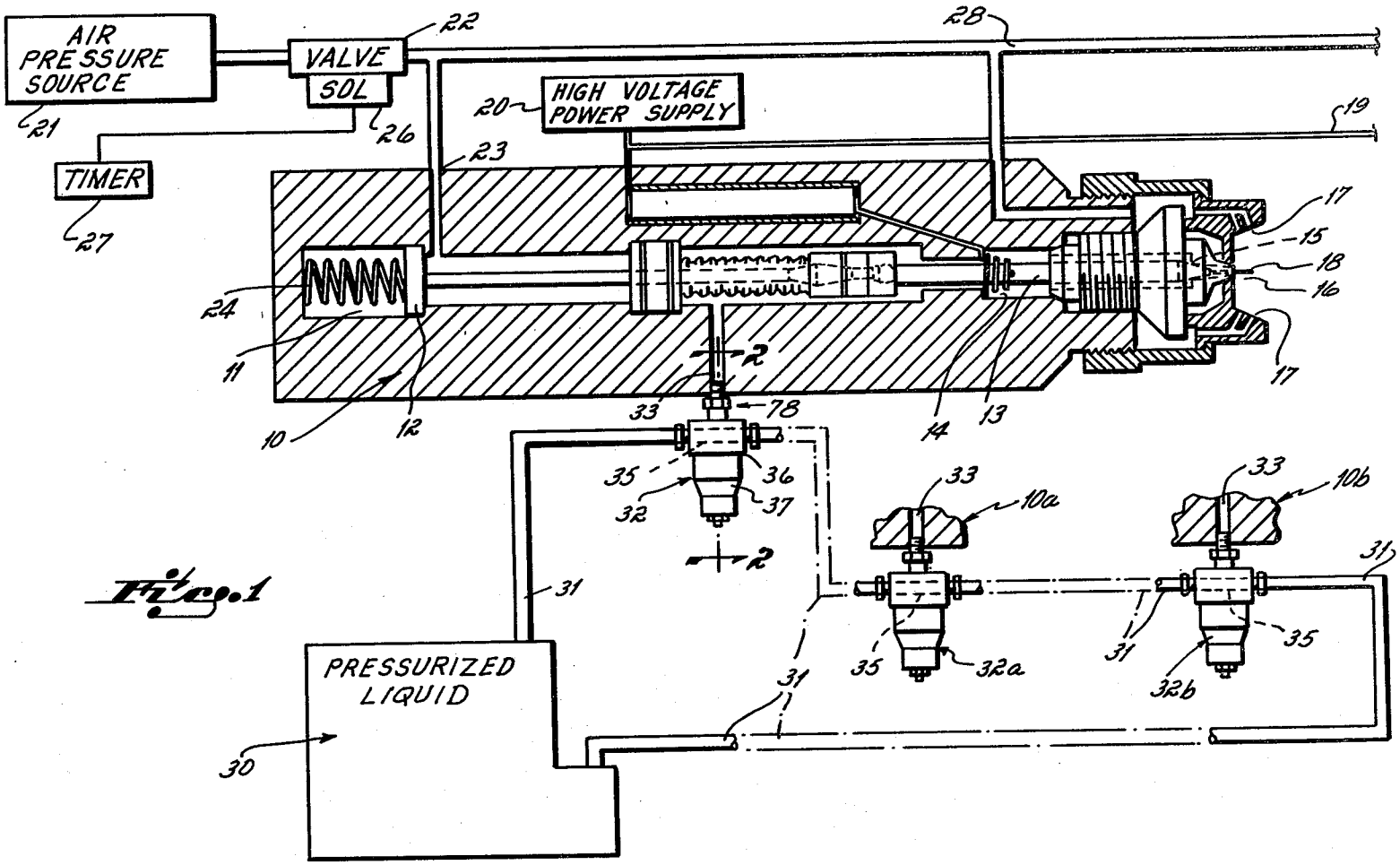
FIG. 1 is a partially diagrammatic illustration of a system incorporating multiple spray guns and pressure regulators of this invention.

Referring to the drawings there is illustrated diagrammatically in FIG. 1 a paint spray system for electrostatically spraying liquid from any one of the three different series connected spray guns 10, 10*a* and 10*b*. Only a fragment of the guns 10*a*, 10*b* has been illustrated in FIG. 1 since the three guns are identical.

Gun 10 is a conventional electrostatic spray gun of the type which has been commercially available for many years. It includes a pneumatic cylinder 11 at the rear of the gun having a piston 12 movable therein and operatively connected to a needle 13 of the spray gun. The needle 13 operates a valve 15 to open or close a central spray material flow passage 14 through which coating material is emitted to a spray nozzle 16 for atomization as it is ejected from the gun. The gun 10 is of the air spray type in which the liquid stream emitted from the nozzle of the gun is impacted by air streams emitted from air orifices 17 in the sides of the nozzle and directed inwardly toward the liquid stream so as to break up and effect atomization of the liquid stream.

In order to increase the deposition efficiency of the gun 10 it includes an electrostatic charge applying needle 18 extending from the discharge orifice of the gun. The needle is supplied with a high voltage electrical charge from a high voltage power supply 20 through a control circuit as is conventional in all electrostatic spray guns. The needles (not shown) for the other series connected guns 10*a* and 10*b* would be supplied with this same high voltage electrical charge via the line 19.

To control actuation of the needle 13 and consequent emission of spray from the gun, air from an air pressure source 21 is supplied to the gun through a solenoid actuated valve 22. When air pressure is supplied to an inlet port 23 of the gun through the valve 22, it causes the piston to move rearwardly against a spring bias and thereby effect opening of the needle valve 15 relative to the valve seat. Simultaneously, air is supplied through the solenoid valve 22 to the nozzle 18 and air flow orifices 17 contained within the nozzle for directing air streams at the liquid stream emitted from the central passage 14 of the gun 10. Closure of the air valve 22 connects the port 23 to atmosphere and allows the spring 24 of the gun to effect closing movement of the needle 13 relative to its seat.

Actuation of the air flow control valve 22 is controlled by a solenoid 26. This solenoid is in turn controlled by a conventional electrical control circuit and timer indicated generally by the numeral 27. This same timer would usually be operative to control air flow via the pneumatic line 28 to the other series connected guns 10*a*, 10*b* since the line 28 would usually be connected to all of the series connected guns.

Liquid paint or other coating material to be sprayed from the gun 10 is supplied from a source 30 of the pressurized liquid. This source 30 is connected by a fluid flow conduit 31 which is connected in a closed loop through pressure regulators 32, 32*a* and 32*b* to each of the guns. Each of the regulators 32, 32*a* and 32*b* is in turn directly attached to an inlet port 33 of one of the guns 10, 10*a*, and 10*b*. The ports 33 are in fluid communication with the internal fluid flow passages 14 of the guns 10, 10*a*, 10*b*.

The source of pressurized liquid 30 may be simply a tank having an air pressure head located over the liquid contained within the tank to force it to flow through circuit 31 at a predetermined pressure, or it may be a tank within which there is located a conventional pump, as for example a single or double acting hydraulic pump. In any event, the liquid supplied from the source to the gun passes through one of the pressure regulators 32, 32*a* or 32*b* before it enters the fluid flow passage of the gun. These regulators function to remove all pressure fluctuations or changes in the liquid pressure from the source before it enters the gun so that the liquid is always maintained at a preset non-varying pressure within the gun.

Each pressure regulator 32 has a straight through bore or passageway 35 which extends through the regulator in a straight line. This passage 35 of each regulator is connected to the closed loop conduit 31 so that the passage 35 of the regulator forms a portion of the closed loop. Because the passages 35 are straight through bores, liquid flowing through the bores 35 of the regulator experiences no pressure drop and consequently the liquid pressure in the line 31 supplied to each of the regulators 32, 32*a* and 32*b* is substantially the same. In the absence of such an unrestricted straight through bore 35, as for example if the bore 35 were smaller in diameter than the conduit 31, or if the bore defined a circuitous flow path through the regulator, there would be a pressure drop in the liquid supplied from one regulator to the next. Such pressure drop might well result in the last regulator in a series of guns being supplied with too little pressure to effect a desired spray pattern.

The pressure regulators 32, 32*a* and 32*b* are all identical and therefore only one regulator 32 has been illustrated and described in detail.

Figure 2:
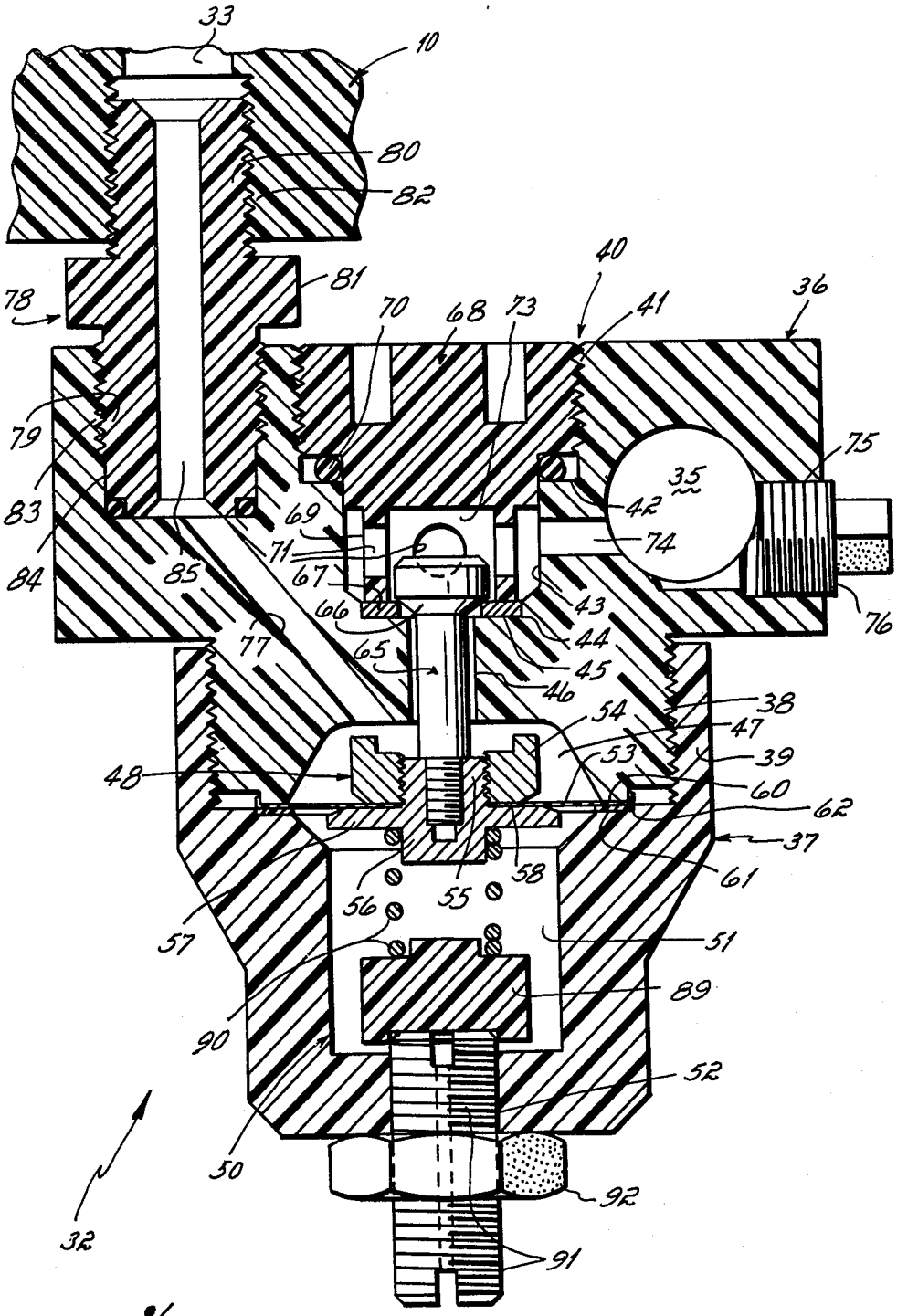
FIG. 2 is a cross sectional view taken on line 2—2 of a regulator utilized in the system of FIG. 1.

With reference now to FIG. 2 it will be seen that the regulator 32 comprises a two-piece body; a base 36, and a bonnet 37. The base has a threaded hub section 38 on its lower end onto which an internally threaded section 39 of the bonnet 37 is secured. As explained hereinafter, this threaded connection between the bonnet and body enables the bonnet to be removed for disassembly of the regulator.

A five different diameter bore 40 extends axially through the base section of the body. This bore 40 comprises a threaded upper end section 41 which is connected via a shoulder 42 to a smaller diameter section 43. The section 43 in turn is connected to a valve seat section of the bore 44. The valve seat of the bore is connected via a shoulder 45 to the smallest diameter section 46. This smallest diameter section 46 opens into a larger diameter section 47 located in the bottom of the base 36. This large diameter bottom section of the bore functions as the upper chamber of a divided chamber within which there is located a movable piston 48.

The bonnet 37 has a two diameter axial bore 50 extending therethrough. The bore 50 comprises an upper diameter section 51 and a smaller diameter lower section 52. The upper larger diameter section functions as the lower chamber of the divided chamber within which the piston 48 is movable. The two chambers 47, 51 of the divided chamber are sealingly separated by a diaphragm 53. The piston 48 is sealingly attached to the diaphragm. This attachment is made by having the diaphragm sandwiched between a brass nut 54 and a base portion 56 of the piston. The base portion 56 of the piston has a hub section 55 which extends through a central aperture of the diaphragm. The nut 54 is threaded onto the hub section so as to sandwich the diaphragm between a flanged section 57 of the base 56 and the bottom face 58 of the nut 54. At its outer edge, the diaphragm is sandwiched between a bottom flat face 60 of the base 36 of the body and a gasket 61 seated within a shoulder 62 formed on the interior of the bonnet.

A needle 65 extends upwardly from and is fixedly attached to the base section 56 of the piston 48. This needle has an outwardly flared tapered upper end section 66 which cooperates with a seat 67 located within the axial bore 40 of the base 36 to form a restricted flow path through the regulator. The valve seat 67 is retained in the bore 40 of the base 36 by a retainer 68 threaded into the upper end section 41 of the bore 40. This retainer 68 has a lower end section 69 which rests against the top of the valve seat 67. This lower section 69 of the retainer has four holes 71 radially spaced about the periphery thereof which open into a blind hole or recess 73. This blind hole 73 functions as a chamber within which the large upper end section 66 of the needle 65 is movable. At its upper end, this retainer has an externally threaded section which is threaded into the threaded section 41 of the bore 40. An O-ring seal 70 is located between the upper threaded section of the retainer and the shoulder 42 of the bore 40.

There is a liquid flow passage 74 which interconnects the section 43 of the bore 40 with the through passage bore 35 in the regulator base 36. This passage 74 is machined through a threaded bore 75 which is closed by a conventional pipe plug 76.

Liquid is supplied to the valve 66, 67 of the pressure regulator from the through bore 35 via passage 74, holes or ports 71 in the retainer, and into the recess 73 in the bottom of the retainer. Liquid flows away from this valve 66, 67 into the upper piston chamber 47. From the piston chamber 47 it flows to the gun via a passage 77 and an adapter 78.

The adapter 78 is externally threaded at its opposite ends. Between the two externally threaded sections 79, 80 there is a hexagonal shaped exterior section 81 which has six flats formed on its outer face for reception of a conventional hand tool, as for example an open end wrench. The upper section 80 of this adapter is threaded directly into a threaded section 82 of the bore 33 in the gun 10. The lower threaded section 79 of the adapter is threaded into a threaded section 83 of a bore 84 in the regulator which communicates with the passage 77. The adapter has a central through bore 85 through which liquid from the passage 77 flows to the passage 33 of the gun.

In order to control pressure which exits from the gun, there is a compression spring 90 located in the chamber 51 of the bonnet 37. One end of the spring 90 rests against the bottom surface of the piston 56 and the other end rests against the top or cap 89 of an adjustment screw 91. This screw passes through a threaded section 52 of the bore in the bonnet. By adjusting the axial position of the screw 91 in the threaded bore 52, the pressure applied by the spring 90 to the piston may be adjusted. The screw 91 is secured in a locked position by a lock nut 92.

All of the external components of the regulator 32 are made of a plastic low capacitance material so that those components can neither transmit nor store an electrical charge. Specifically, the regulator body, including the base 36 and bonnet 37, the plug 76, the adjustment screw 91, lock nut 92, retainer 68 and adapter 78 are all made from nylon. In fact, the only metal components contained within the regulator are the needle 65 which is made from stainless steel, the compression spring 90, which is made of stainless steel, and the piston 48 which is made from a brass base 56 and a brass nut 54. These metal components are all relatively small and are very well shielded by low capacitance components of the regulator. Consequently, the regulator cannot transmit or store any appreciable electrical charge.

In use, liquid is supplied from the pressurized source 30 by the conduit 31 to the through bores 35 of the regulators. This liquid is supplied at a higher pressure than is desired at the internal passage 14 of the gun. The liquid flows from the bore 35 of the regulator through the passage 74, holes 71, into the recess 73 contained in the retainer nut. From the recess 73 liquid flows via the restricted orifice located between the valve 66 and the valve seat 67 into the upper chamber 47 of the regulator. In the course of passage through the restricted orifice of the valve 66, 67 there is a pressure drop which lowers the pressure of liquid to the pressure desired in the interior of the gun 10. The compression on the spring 90 determines the output pressure of the regulator supplied through the passages 77, 85 to the gun 10.

There is sometimes a need for a pressure regulator which is pneumatically controlled rather than manually adjusted by the spring 90. The regulator 32 is easily converted from manual to pneumatic control by simply removing the bonnet 37 from the base and withdrawing the spring 90 and cap 89 of the adjustment screw. The adjustment screw 91 and lock nut 92 are then removed from the bonnet and the bonnet replaced on the base 36. A pneumatic line (not shown) is then threaded into the bore 52 from which the adjustment screw was removed. The regulator may then be controlled by air pressure supplied to the bore 52 and consequently to the lower chamber 51 of the regulator by the pneumatic line attached to the bore 52. Otherwise expressed, by simply removing the spring and adjust screw and replacing those components with a pneumatic line threaded into the bore 52, the regulator may be converted from manual spring adjustment to pneumatic control air pressure adjustment.

In addition to this regulator having the advantage of being easily converted from manual to pneumatic control, this regulator has the advantage of being capable of direct attachment to an electrostatic spray gun without creating a dangerous condition. Specifically, because the external components of the gun are made from a low electrical capacitance material the gun is not capable of either transmitting or storing an electrical charge. Therefore, the regulator may be safely mounted directly upon an electrostatic spray gun without the need for a long electrical hose or conduit between the regulator and the gun. If the paint or liquid spray material is heated, as is often the case, direct attachment of the regulator to the gear eliminates the problem of liquid cooling in the conduit between the regulator and the gun when the gun is turned off. With this invention that conduit is eliminated so that there is no cooling problem between the gun and the regulator.

This regulator also has the advantage of eliminating pressure drop between several series connected regulators. Such pressure drops have heretofore been particularly troublesome when several series connected guns were used to spray "high solid" materials, i.e., materials which contained a high percentage of solids compared to the percentage of liquid within which the solids are transported.

While we have described only one embodiment of our invention, persons skilled in the art to which this invention pertains will appreciate numerous changes and modifications which may be made without departing from the spirit of our invention. Therefore, we do not intend to be limited except by the scope of the following appended claims.

Having described our invention we claim:

1. In combination, an electrostatic spray gun and a pressure regulator for controlling the pressure of liquid dispensed from the gun, said spray gun comprising a non-metallic, low capacitance gun body, a liquid material flow passage in the gun body terminating in an outlet orifice, and a selectively operable valve contained within the gun body for controlling the emission of spray material from said orifice, said spray gun further including means for applying an electrical charge to spray material as it is emitted from said spray gun, said pressure regulator comprising a regulator body physically attached to and supported from said gun body, said regulator body being made from non-metallic, low capacitance material, said pressure regulator having a first straight line flow passage therethrough so as to minimize pressure drop of liquid flowing through said regulator via said first flow passage, said pressure regulator having a second passage intersecting said first passage for connecting said first passage to said liquid material flow passage in the gun body, said second passage including pressure regulator valve means therein for regulating the pressure of liquid supplied from said straight line flow passage through said second passage to said flow passage in the gun body.

2. The combination of claim 1 in which all of the external components of said regulator body are made from non-metallic components.

3. The combination of claim 1 wherein said pressure regulator includes an upper and lower chamber sealingly separated by a diaphragm, said upper chamber being in fluid flow communication with said second flow passage of said pressure regulator, valve mechanism operatively connected to said diaphragm and extending into said second flow passage so as to throttle flow of liquid through said second flow passage to said spray gun, and adjustable compression spring means located within said lower chamber for biasing said valve mechanism to an open position to permit flow of liquid from said first passage of said pressure regulator to said spray gun at a predetermined regulated pressure.

4. The combination of claim 3 wherein said adjustable spring means of said pressure regulator is removable from said lower chamber, and wherein an air pressure line is connectable to said lower chamber whereby air pressure may be substituted for the mechanical spring pressure to control the pressure of liquid supplied from said pressure regulator to said spray gun.

5. The combination of claim 3 wherein said pressure regulator includes a piston secured to said diaphragm, said valve mechanism including a valve needle secured to said piston, said adjustable compression spring means comprising an adjustment screw extending through a port in said regulator body and into said lower chamber, and a compression spring extending between said piston and said adjustment screw.

6. The combination of claim 5 wherein said adjustment screw and said compression spring are removable from said pressure regulator and an air pressure line is connectable to said regulator body port after removal of the adjustment screw so as to convert said pressure regulator without any other modification of the pressure regulator from mechanical to pneumatic control of the pressure of liquid supplied from said pressure regulator to said spray gun.

7. In combination, a spray gun and a pressure regulator mounted upon and attached to said gun for controlling the pressure of liquid dispensed from the gun, said spray gun comprising a gun body, a liquid material flow passage in the gun body terminating in an outlet orifice, and a selectively operable valve contained within the gun body for controlling the emission of spray material from said orifice, said pressure regulator being physically attached to said gun body, said pressure regulator having a first straight line flow passage therethrough so as to minimize pressure drop of liquid flowing through said pressure regulator via first flow passage, said pressure regulator having a second passage intersecting said first passage for connecting said first passage to said liquid material flow passage in the gun body, said pressure regulator having an upper and lower chamber sealingly separated by a diaphragm, said upper chamber being in fluid communication with said second flow passage of said pressure regulator, valve mechanism operatively connected to said diaphragm and extending into said second flow passage so as to throttle flow of liquid through said second flow passage to said spray gun, and adjustable compression spring means located within said lower chamber for biasing said valve mechanism to an open position to permit flow of liquid from said first passage of said pressure regulator to said spray gun at a predetermined regulated pressure.

8. The combination of claim 7 wherein said adjustable spring means of said pressure regulator is removable from said lower chamber, and wherein an air pressure line is connectable to said lower chamber whereby air pressure may be substituted for the mechanical spring pressure to control the pressure of liquid supplied from said pressure regulator to said spray gun.

9. The combination of claim 7 wherein said pressure regulator includes a piston secured to said diaphragm, said valve mechanism including a valve needle secured to said piston, said adjustable compression spring means comprising an adjustment screw extending through a port in said regulator body and into said lower chamber, and a compression spring extending between said piston and said adjustment screw.

10. The combination of claim 9 wherein said adjustment screw and said compression spring are removable from said pressure regulator and an air pressure line is connectable to said regulator body port after removal of the adjustment screw so as to convert said pressure regulator without any other modification of the pressure regulator from mechanical to pneumatic control of the pressure of liquid supplied from said pressure regulator to said spray gun.

* * * * *

UNITED STATES PATENT AND TRADEMARK OFFICE

Certificate

Patent No. 4,368,852 Patented January 18, 1983

William J. Sharp, Harold D. Beam and William A. Armstrong

Application having been made by William J. Sharp, Harold D. Beam, and William A. Armstrong the inventors named in the patent above-identified, and Nordson Corp., the assignee, for the issuance of a certificate under the provisions of Title 35, Section 256, of the United States Code, adding the name of Edward R. Love as a joint inventor, and a showing and proof of facts satisfying the requirements of the said section having been submitted, it is this 6th day of Mar., 1984, certified that the name of the said Edward R. Love is hereby added to the said patent as a joint inventor with the said William J. Sharp, Harold D. Beam, and William A. Armstrong.

Fred W. Sherling,
*Associate Solicitor.*